US006772684B2

(12) United States Patent
Kanayama

(10) Patent No.: US 6,772,684 B2
(45) Date of Patent: Aug. 10, 2004

(54) INK FOUNTAIN APPARATUS FOR ROTARY PRINTING PRESS

(75) Inventor: Tomoya Kanayama, Chiba (JP)

(73) Assignee: Komori Corporation, Tokyo (JP)

( * ) Notice: Subject to any disclaimer, the term of this patent is extended or adjusted under 35 U.S.C. 154(b) by 93 days.

(21) Appl. No.: 09/895,622

(22) Filed: Jun. 29, 2001

(65) Prior Publication Data

US 2003/0164104 A1 Sep. 4, 2003

(30) Foreign Application Priority Data

Jun. 30, 2000 (JP) ..... 2000-198698

(51) Int. Cl.[7] ..... B41F 31/06; B41F 31/00

(52) U.S. Cl. ..... 101/350.1; 101/208; 101/210; 101/364

(58) Field of Search ..... 101/207, 350.7, 101/208, 210, 363, 364; 118/216

(56) References Cited

U.S. PATENT DOCUMENTS 1,890,922 A * 12/1932 Waller ..... 101/152
1,893,148 A * 1/1933 Page ..... 101/210
1,919,283 A * 7/1933 Troy ..... 101/210
1,953,105 A * 4/1934 Flinker ..... 101/210
2,301,535 A * 11/1942 Green ..... 101/210
2,514,653 A 7/1950 Lerch
2,920,558 A * 1/1960 Hewlett ..... 101/364
3,319,563 A * 5/1967 Champion et al. ..... 101/207
4,419,932 A * 12/1983 Cappel ..... 101/363
4,991,504 A * 2/1991 Fina ..... 101/208
5,894,798 A * 4/1999 Miyoshi et al. ..... 101/363

FOREIGN PATENT DOCUMENTS

JP U6-46675 11/1994

* cited by examiner

*Primary Examiner*—Andrew H. Hirshfeld
*Assistant Examiner*—Leo T. Hinze
(74) *Attorney, Agent, or Firm*—Blakely, Sokoloff, Taylor & Zafman

(57) ABSTRACT

An ink fountain device for a rotary printing press includes a rotatably supported ink fountain roller, ink fountain, at least one intermediate ink dam, a press unit, and an adjustment bolt. The ink fountain is comprised of an ink fountain blade and a pair of ink dams. The intermediate ink dam includes a press plate, an adjustable plate, and an operation plate. The press unit presses the press plate through the operation plate and adjustment plate toward the outer surface of the ink fountain roller and toward the ink fountain blade. The adjustment bolt adjusts a tight contact state of the press plate with respect to at least one of the outer surface of the ink fountain roller and the fountain blade.

15 Claims, 4 Drawing Sheets

INK FOUNTAIN APPARATUS FOR ROTARY PRINTING PRESS

BACKGROUND OF THE INVENTION

The present invention relates to an ink fountain apparatus for a rotary printing press, which stores ink to be supplied to a plate surface and, more particularly, to the structure of intermediate ink dams arranged between a pair of opposing ink dams.

When printing is to be performed with a rotary printing press, the plate sometimes has a pattern at only its portion in the entire width depending on the specifications of the printing products to be obtained. In this case, if ink is stored in the entire ink fountain and printing is performed, the ink may be wasted. Hence, intermediate ink dams are formed on two sides of a portion corresponding to the pattern, and the ink is stored in only inside the intermediate ink dams. In rainbow printing wherein inks of different colors are supplied to appropriate portions in the entire length of the plate cylinder and several colors are printed at once, intermediate ink dams are provided so adjacent inks do not mix with each other. Japanese Utility Model Publication No. 6-46675 (reference 1) discloses an ink fountain apparatus of this type.

The ink fountain apparatus shown in reference 1 has an intermediate ink dam unit, movable in the axial direction, on a holder shaft extending parallel to an ink fountain roller. The intermediate ink dam unit has a holder fitted on the holder shaft, a support plate pivotally supported by the holder through a link, an intermediate ink dam fixed to the support plate and made of an elastic material, a spring for pressing the edge of the intermediate ink dam to abut against a blade, and a pivoting force application member for applying a pivoting force to the holder in a direction to press the intermediate ink dam to abut against the outer surface of the fountain roller.

In this arrangement, because of cooperation with the elastic force of the spring member, the acting force of the pivoting force application member, and the link motion, the elastic edge of the intermediate ink dam is pressed by the outer surface of the ink fountain roller and the flat surface of the blade to abut against them, and comes into tight contact with them.

In the conventional ink fountain apparatus described above, the intermediate ink dam is brought into tight contact with the outer surface of the ink fountain roller and the blade by pivoting the whole intermediate ink dam with the pivoting force application member. In this pivot motion, although the whole intermediate ink dam can be brought into tight contact with the outer surface of the ink fountain roller and the blade, it cannot necessarily be brought into uniform contact with them due to a working tolerance, non-uniform wear, or the like. Therefore, in the conventional ink fountain apparatus, the tight contact force cannot be partially adjusted.

Accordingly, when the tight contact force of the intermediate ink dam decreases partially, the ink flows out through this portion, so the amount of ink consumed may increase, and the printing quality degrades in rainbow printing or the like. When the intermediate ink dam is to be removed, the link mechanism and the like must be removed, resulting in a cumbersome operation.

SUMMARY OF THE INVENTION

It is an object of the present invention to provide an ink fountain apparatus for a rotary printing press, in which the consumption of ink is reduced by preventing outflow of the ink.

It is another object of the present invention to provide an ink fountain apparatus for a rotary printing press, in which the printing quality in rainbow printing is improved.

It is still another object of the present invention to provide an ink fountain apparatus for a rotary printing press, in which an intermediate ink dam can be removed easily.

In order to achieve the above objects, according to the present invention, there is provided an ink fountain apparatus for a rotary printing press, comprising a rotatably supported ink fountain roller, an ink fountain comprised of a bottom plate with one end supported close to the ink fountain roller and a pair of ink dams standing upright from the bottom plate to correspond to two ends of the ink fountain roller and arranged to oppose in an axial direction of the ink fountain roller, at least one intermediate ink dam standing upright between the ink dams from the bottom plate, the intermediate ink dam including a first member in contact opposite to an outer surface of the ink fountain roller and the bottom plate, a second member in contact opposite to the first member, and a third member in contact opposite to the second member, press means for pressing the first member through the third and second members toward the outer surface of the ink fountain roller and toward the bottom plate, and an adjustment tool for adjusting a tight contact state of the first member with respect to at least one of the outer surface of the ink fountain roller and the bottom plate.

DESCRIPTION OF THE PREFERRED EMBODIMENT

The present invention will be described in detail with reference to the accompanying drawings.

Figure 2:
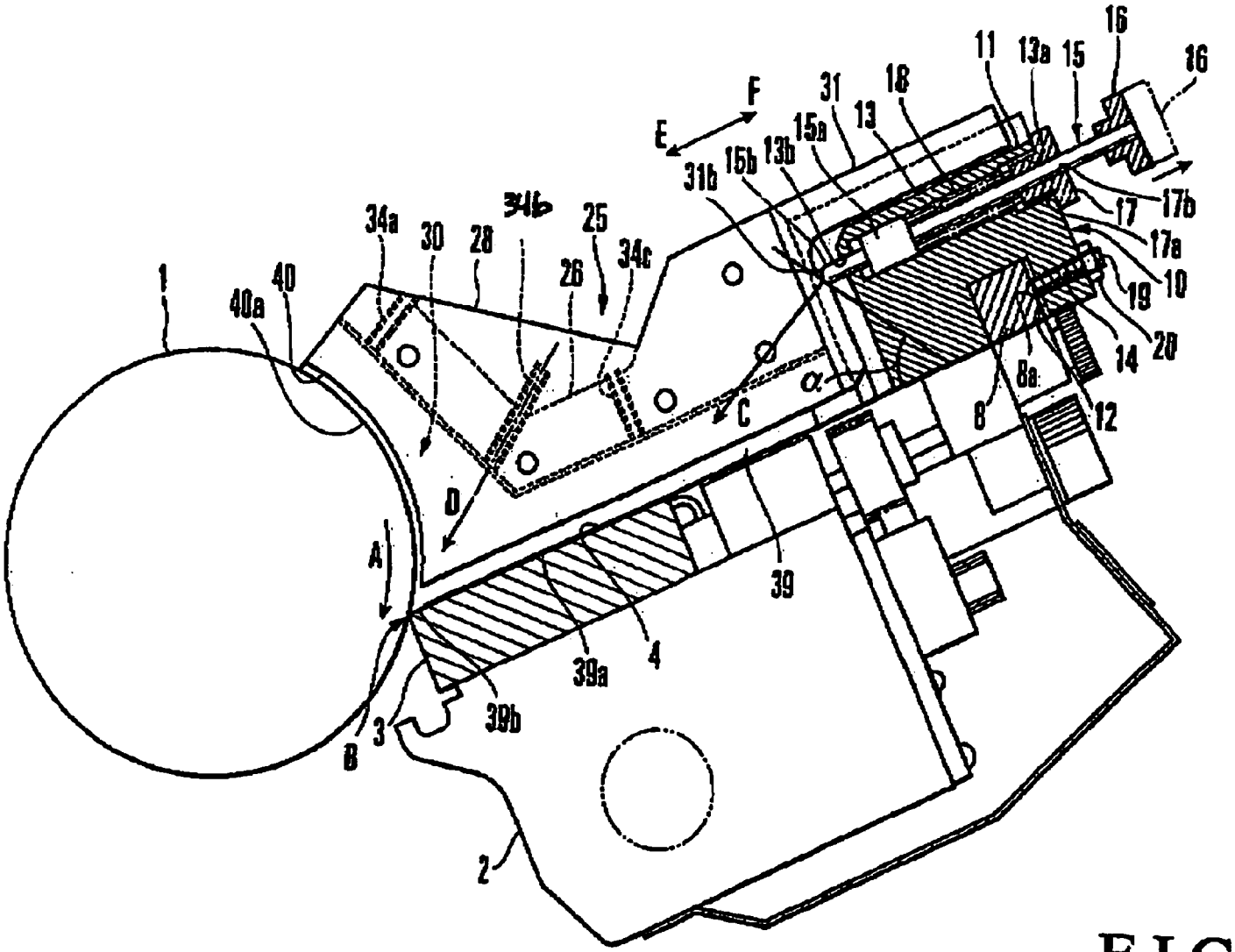
FIG. 2 is a sectional view taken along the line II—II of FIG. 1.

FIG. 2 shows an ink fountain apparatus for a rotary printing press according to an embodiment of the present invention. Referring to FIG. 2, an ink fountain roller 1 rotatable in the direction of an arrow A axially extends between a pair of frames (not shown) arranged to oppose each other through a predetermined distance, and a blade base 2 is provided beside the ink fountain roller 1 such that its two ends are supported by the pair of frames. A large number of ink fountain keys 3 divided in the axial direction of the ink fountain roller 1 are placed on a slant surface at the upper end of the blade base 2. When a motor (not shown) is driven, the aperture ratios of the distal ends of the ink fountain keys 3 are adjusted in directions to become close to and away from the outer surface of the ink fountain roller 1.

Figure 1:
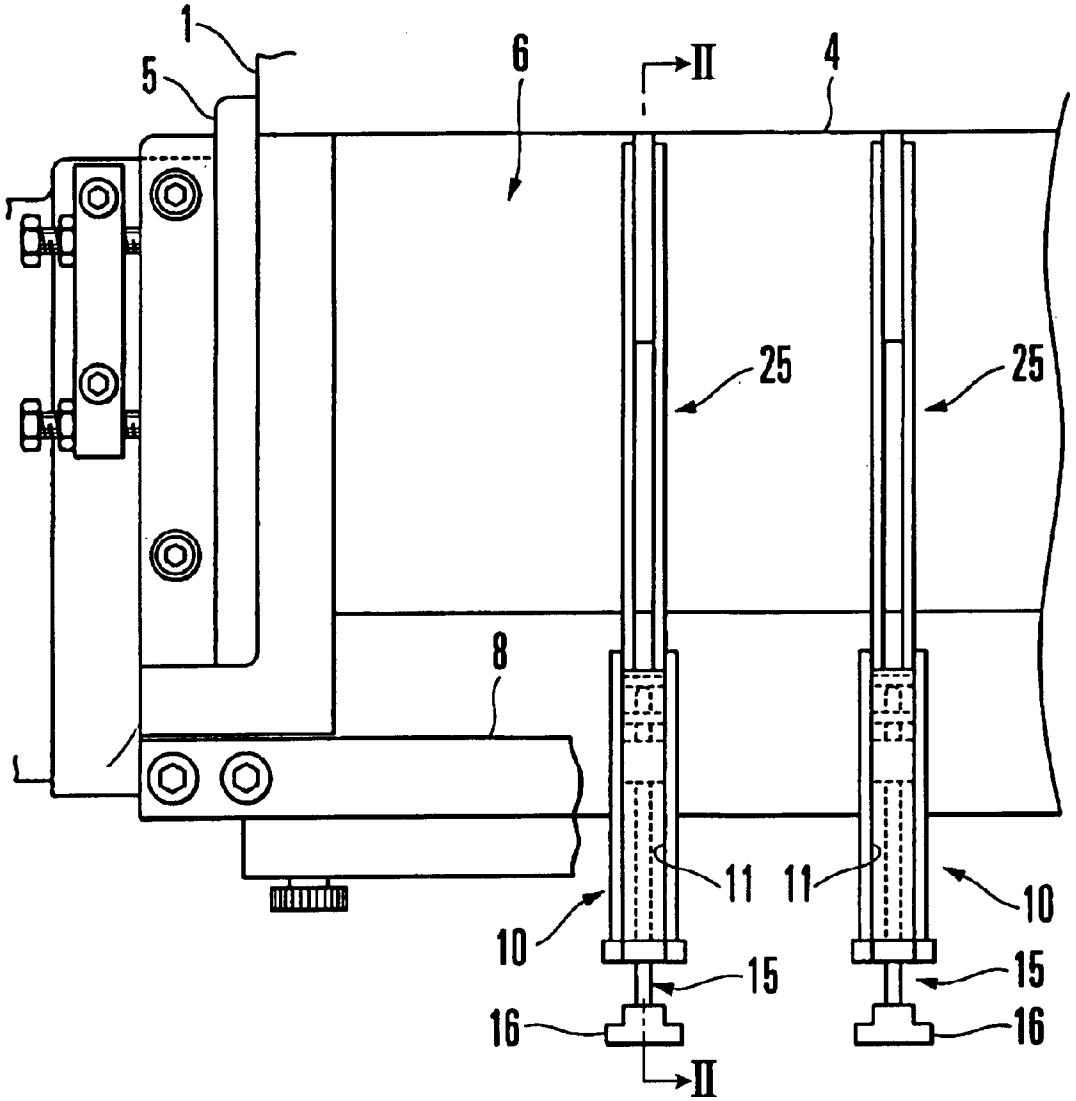
FIG. 1 is a plan view of the main part of an ink fountain apparatus for a rotary printing press according to an embodiment of the present invention.

One ink fountain blade 4 formed of a thin steel plate to serve as a bottom plate is magnetically attracted so it comes into tight contact with the ink fountain key 3 to cover the large number of ink fountain keys 3. Referring to FIG. 1, a pair of opposing ink dams 5 arranged to correspond to the two ends of the ink fountain roller 1 are fixed to a member (not shown) swingably supported between the frames, such that the inner surfaces of their distal ends are pressed by the two end faces of the ink fountain roller 1. The pair of ink dams 5 standing upright from the ink fountain blade 4, the outer surface of the ink fountain roller 1, and the ink fountain blade 4 make up a tub-like ink fountain 6. A bar 8 extending in the axial direction of the ink fountain roller 1 behind the ink fountain 6 has two ends fixed to the member (not shown) swingably supported between the frames.

Figure 4:
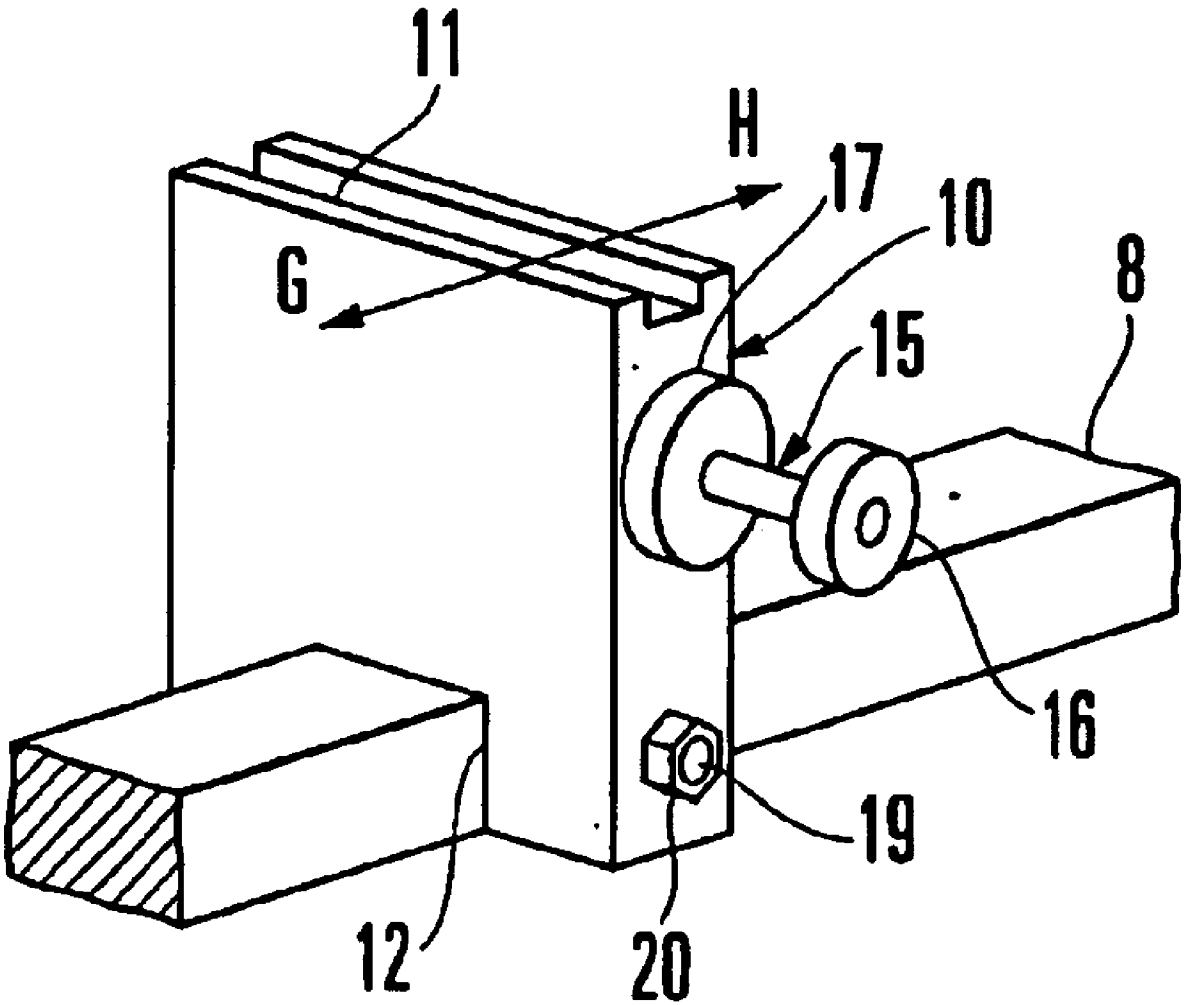
FIG. 4 is a perspective view of the holder of the ink fountain apparatus shown in FIG. 1.

As shown in FIG. 4, a thin-plate-like rectangular parallelepiped holder 10 has a fitting groove 11 with a U-shaped section to communicate with its upper end and its side surface on the ink fountain roller 1 side, and a notch 12, extending in the axial direction of the ink fountain roller 1, in its lower end. The notch 12 is slightly larger than the sectional area of the bar 8. As shown in FIG. 2, a blind hole-like spring accommodating hole 13 is formed in the upper portion of the holder 10. A threaded portion 13*a* is formed at the inlet port of the spring accommodating hole 13, and a small-diameter insertion hole 13*b* is formed in the spring accommodating hole 13 to reach its bottom. A screw hole 14 with a screw portion extending to reach a recess 8*a* of the bar 8 is formed in the lower portion of the holder 10.

Referring to FIG. 2, an operation rod 15 serving as a thin, elongated press member has a spring accepting portion 15*a*, with a diameter slightly smaller than the diameter of the spring accommodating hole 13, at its distal end. A press shaft portion 15*b* with a diameter slightly smaller than the diameter of the insertion hole 13*b* projects from one end of the spring accepting portion 15*a* toward the ink fountain roller 1. A handle member 16 is fixed to the proximal end (counter distal end) of the operation rod 15. A screw 17 has a screw portion 17*a* threadably engageable with the threaded portion 13*a* of the spring accommodating hole 13, and an insertion hole 17*b* with a diameter slightly larger than the diameter of the operation rod 15 is formed at the center of the screw 17.

A compression coil spring 18 serving as a biasing means is elastically mounted between the spring accepting portion 15*a* of the operation rod 15 inserted in the spring accommodating hole 13 and the screw 17 with the screw portion 17*a* threadably engaging with the threaded portion 13*a*. The press shaft portion 15*b* of the operation rod 15 in the insertion hole 13*b* is then biased from the holder 10 in a direction to become close to the ink fountain roller 1. A set screw 19 threadably engages with the screw hole 14 of the holder 10 and serves to fix the holder 10 to the bar 8. A nut 20 threadably engages with the set screw 19 and serves to regulate forward/backward movement of the set screw 19.

Figure 3:
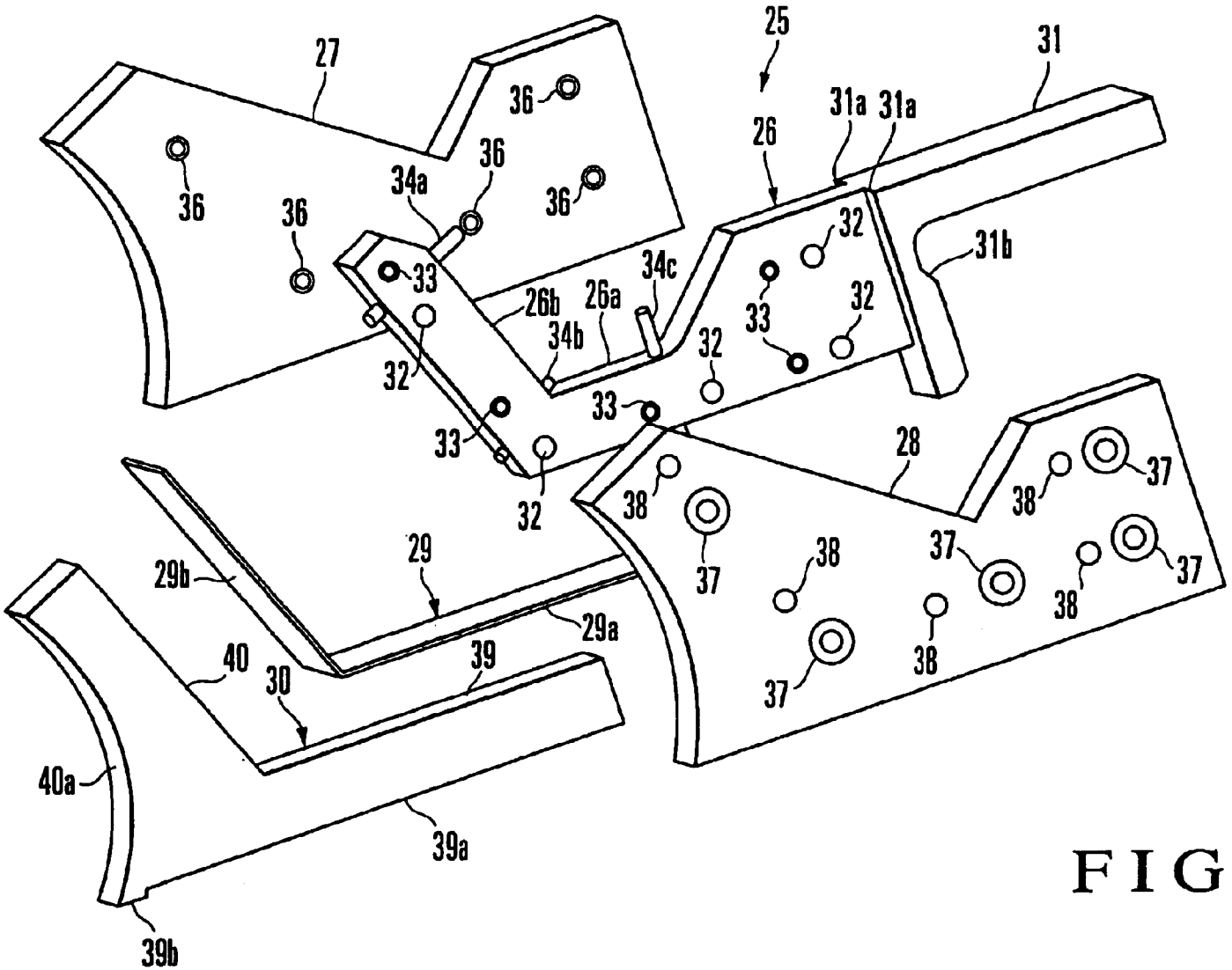
FIG. 3 is an exploded perspective view of the main part of the ink fountain apparatus shown in FIG. 1.

Referring to FIG. 1, a pair of opposing intermediate ink dams 25 are arranged between the ink dams 5. As shown in FIG. 3, each intermediate ink dam 25 is comprised of an operation plate (third member) 26, a pair of sandwiching plates 27 and 28 for sandwiching the operation plate 26 from two sides, an adjustment plate (second member) 29 in contact opposite to the lower surface of the operation plate 26, and a press plate (first member) 30 having an upper end face in contact opposite to the lower surface of the adjustment plate 29. The press plate 30 is arranged in the same planar direction as those of the operation plate 26 and sandwiching plates 27 and 28.

The operation plate 26 is formed of a horizontal portion 26*a* extending in a direction perpendicular to the axial direction of the ink fountain roller 1 and an upright portion 26*b* extending obliquely upward from the distal end of the horizontal portion 26*a*, to have a substantial L shape. A substantially L-shaped support 31 is integrally formed at the front end of the horizontal portion 26*a* to be thicker than the horizontal portion 26*a* because of steps 31*a*. The horizontal portion of the support 31 is fitted in the fitting groove 11 of the holder 10, and part of the vertical portion of the support 31 forms an engaging surface 31*b* formed of a slant surface. As shown in FIG. 2, the slanting direction of the engaging surface 31*b* is set such that an angle $\alpha$ formed by the upper surface of the ink fountain blade 4 and the extension of the slant surface of the engaging surface 31*b* is an acute angle.

As shown in FIG. 3, the operation plate 26 has, in its the horizontal portion 26*a* and upright portion 26*b*, a total of five insertion holes 32 and a total of five screw holes 33. Three adjustment bolts 34*a*, 34*b*, and 34*c* threadably engage with screw holes formed at the upper and lower portions of the upright portion 26*b* and the substantial center of the horizontal portion 26*a* of the operation plate 26. The adjustment bolt 34*b* attached to the lower portion of the upright portion 26*b* moves forward/backward (in the direction indicated by an arrow D) toward a point B where the outer surface of the ink fountain roller 1 and the ink fountain key 3 oppose each other. The sandwiching plate 27 has five screw holes 36 corresponding to the insertion holes 32 of the operation plate 26. The sandwiching plate 28 has five insertion holes 37 with spot-faced upper surfaces to correspond to the insertion holes 32 of the operation plate 26, and five insertion holes 38 corresponding to the screw holes 33.

The adjustment plate 29 is formed by bending a thin steel plate with spring properties into a substantial L shape. The adjustment plate 29 is comprised of a horizontal portion 29*a* in contact opposite to the lower surface of the horizontal portion 26*a* of the operation plate 26, and an upright portion 29*b* in contact opposite to the rear end face of the upright portion 26*b*. The press plate 30 standing upright in contact with the lower surface of the adjustment plate 29 is made of polyvinyl chloride as an elastic material with an overall wear resistance into a substantial L shape. The press plate 30 is comprised of a horizontal portion 39 with an upper end face in contact opposite to the horizontal portion 29*a* of the adjustment plate 29, and an upright portion 40 with a front end face in contact opposite to the upright portion 29*b* of the adjustment plate 29.

The lower end face of the horizontal portion 39 of the press plate 30 serves as a linear blade press portion 39*a* for pressing the blade 4, and the rear end face of the upright portion 40 serves as an arcuate ink fountain press portion 40*a* for pressing the outer surface of the ink fountain roller 1. The width of the adjustment plate 29 and the plate thickness of the press plate 30 are almost the same, and are slightly smaller than the thicknesses of the horizontal portion 26*a* and upright portion 26*b* of the operation plate 26.

How to build the intermediate ink dam 25 in the ink fountain 6 will be described.

As shown in FIG. 3, flat head screws (not shown) inserted from the insertion holes 37 of the sandwiching plate 28 extend through the insertion holes 32 of the operation plate 26, to threadably engage with the screw holes 36 of the sandwiching plate 27. This fixes the sandwiching plate 28 to the sandwiching plate 27 to sandwich the operation plate 26. Then, set screws (not shown) are inserted from the insertion holes 38 of the sandwiching plate 28 to threadably engage with the screw holes 33 of the operation plate 26. This fixes the operation plate 26 to the sandwiching plate 28, so the operation plate 26 is sandwiched between the sandwiching plates 27 and 28.

When the operation plate 26 is sandwiched by the sandwiching plates 27 and 28, a space between the sandwiching plates 27 and 28 is formed under the operation plate 26. The adjustment plate 29 and press plate 30 are sequentially engaged in this space, so the adjustment plate 29 is in contact opposite to the lower surface of the operation plate 26 and the press plate 30 is in contact opposite to the lower surface of the adjustment plate 29. When the support 31 of the intermediate ink dam 25 built in this manner is fitted in the fitting groove 11 of the holder 10, as shown in FIG. 2, the intermediate ink dam 25 is supported in the fitting groove 11 to be slidable in a direction indicated by arrows E–F perpendicular to the axial direction of the ink fountain roller 1.

At this time, the blade press portion 39*a* and ink fountain press portion 40*a* of the press plate 30 project from the lower and rear ends, respectively, of each of the sandwiching plates 27 and 28. The elastic force of the compression coil spring 18 biases the operation rod 15 in a direction indicated by the arrow E to become close to the ink fountain roller 1, and the distal end of the press shaft portion 15*b* projecting from the insertion hole 13*b* abuts against the engaging surface 31*b* of the support 31. Since the engaging surface 31*b* is formed in such a direction that the angle $\alpha$ formed by the ink fountain blade 4 and the extension of the slant surface 31*b* is an acute angle, the press direction with respect to the press plate 30 changes as indicated by an arrow C. More specifically, the press plate 30 is pressed almost toward the point B where the outer surface of the ink fountain roller 1 and the ink fountain key 3 oppose each other. Therefore, the blade press portion 39*a* and ink fountain press portion 40*a* of the press plate 30 respectively press the ink fountain blade 4 and the outer surface of the ink fountain roller 1, and accordingly the blade press portion 39*a* and ink fountain press portion 40*a* come into tight contact with the ink fountain blade 4 and the outer surface of the ink fountain roller 1, respectively.

In this embodiment, since the operation plate 26 presses the press plate 30 through the thin plate-like adjustment plate 29, the press plate 30 is pressed uniformly and will not be locally fractured. Since the adjustment plate 29 is made of an elastic material, local elastic deformation of the press plate 30 can be prevented, so the tight contact force becomes uniform throughout the press plate 30.

How to adjust the tight contact state of the press plate 30 with respect to the ink fountain blade 4 and the outer surface of the ink fountain roller 1 will be described.

When the tight contact state of the whole press plate 30 is to be adjusted, the screw 17 is pivoted to change the forward/backward moving amount of the screw 17 with respect to the spring accommodating hole 13, thereby changing the elastic force of the compression coil spring 18. Thus, the press force of the compression coil spring 18 to press the press shaft portion 15*b* toward the engaging surface 31*b* changes, so the whole tight contact can be adjusted. This adjusting operation can be performed by only pivoting the screw 17. Therefore, tight contact adjustment can be performed easily.

If tight contact between the blade press portion 39*a* and ink fountain blade 4 and that between the ink fountain press portion 40*a* and the outer surface of the ink fountain roller 1 are partly insufficient, the threadable engagement amounts of the adjustment bolts 34*a*, 34*b*, and 34*c* are adjusted separately, to adjust the tight contact partly. In this case, when the threadable engagement amount of the adjustment bolt 34*b*, which moves forward/backward with respect to the point B where the outer surface of the ink fountain roller 1 and the ink fountain keys 3 oppose each other, is adjusted, the tight contact between the blade press portion 39*a* and ink fountain blade 4 and that between the ink fountain press portion 40*a* and the outer surface of the ink fountain roller 1 can be adjusted simultaneously.

According to this embodiment, the tight contact state of the press plate 30 can be partly adjusted, so partial outflow of the ink can be prevented. As a result, the amount of ink consumed can be reduced, and the printing quality of rainbow printing can be improved. As the press plate 30 is made of the elastic material, when the press state is to be partly adjusted, partial deformation of the press plate 30 due to the adjustment bolts 34*a* to 34*c* can be prevented.

As shown in FIG. 3, a projection 39*b* for pressing the upper surface of the distal end of the corresponding ink fountain key 3 is formed at the distal end of the blade press portion 39*a* of the press plate 30. Since the projection 39*b* locally presses the upper surface of the distal end of the ink fountain key 3, the tight contact of the press plate 30 is further improved, and the ink from the ink fountain roller 1 is prevented from entering a portion between the blade press portion 39*a* and ink fountain blade 4, through the blade press portion 39*a* and the ink fountain key 3. As a result, ink to be used for subsequent printing is prevented from mixing with printing ink used previously. Also, the ink fountain key 3 is prevented from causing an operation error because the entering ink solidifies.

Since the press plate 30 is made of the wear-resistant elastic material, wear of the press plate 30 at its portion in contact opposite to the ink fountain roller 1 and that in contact opposite to the ink fountain blade 4 are reduced. Also, the tight contact of the press plate 30 at its portion in contact opposite to the ink fountain roller 1 and that in contact opposite to the ink fountain blade 4 are improved.

To remove the intermediate ink dam 25, as shown in FIG. 2, the operator holds the holding member 16, and moves the operation rod 15 against the elastic force of the compression coil spring 18 in a direction to separate it away from the ink fountain roller 1. Then, the operator releases the engaging surface 31*b* which has been pressed by the press shaft portion 15*b*, and removes the operation rod 15 from the holder 10. In this manner, the intermediate ink dam 25 can be mounted and detached by merely moving the operation rod 15 against the elastic force of the compression coil spring 18 without requiring a tool. Thus, the intermediate ink dams 25 can be mounted and detached easily.

When the intermediate ink dam 25 is to be positionally adjusted in the axial direction of the ink fountain roller 1, in FIG. 2, the operator loosens the fastened nut 20 and rotates the set screw 19 to move it backward. Then, as shown in FIG. 4, the operator releases the holder 10 which has been fixed to the bar 8, and moves the holder 10 in the axial direction of the ink fountain roller 1 indicated by arrows G–H. In this manner, position adjustment of the intermediate ink dam 25 can be performed by merely loosening the fastened nut 20 and thereafter rotating the set screw 19. As a result, operation becomes easy.

In the above embodiment, the press plate 30 is made of polyvinyl chloride. However, the present invention is not limited to this, but the press plate 30 can be made of any elastic material as far as it has wear resistance.

As has been described above, according to the present invention, the tight contact state between the intermediate ink dam and blade and that between the intermediate ink dam and the outer surface of the ink fountain roller are partially adjusted, so the tight contact force is improved and partial outflow of the ink can be prevented. Therefore, the amount of ink consumed is reduced, and the printing quality of rainbow printing is improved.

What is claimed is:

1. An ink fountain apparatus for a rotary printing press, comprising:

a rotatably supported ink fountain roller; an ink fountain comprised of a bottom plate with one end supported close to said ink fountain roller and a pair of ink dams standing upright from said bottom plate to correspond to two ends of said ink fountain roller and arranged to oppose in an axial direction of said ink fountain roller;

at least one intermediate ink dam standing upright between said ink dams from said bottom plate, said intermediate ink dam including a first member in contact opposite to an outer surface of said ink fountain roller and said bottom plate, a second member in contact opposite to said first member, and a third member in contact opposite to said second member;

press means for pressing first member through said third and second members toward the outer surface of said ink fountain roller and toward said bottom plate, wherein said press means comprises a holder with a first through hole and adapted to support said intermediate ink dam to be movable in a direction to become close to and away from said ink fountain roller, a rod press member supported in the first through hole to be movable in a moving direction of said intermediate ink dam and with a distal end projecting from one end of the first through hole to abut against said third member, said press member having a spring accepting portion, a screw with a second through hole in which said press member extends and threadably engageable with the other end of the first through hole, and a spring mounted between the spring accepting portion and said screw and adapted to bias the distal end of said press member to press said third member, said spring having a biasing force adjusted by pivot motion of said screw;

and an adjustment tool for adjusting a tight contact state of said first member with respect to at least one of the outer surface of said ink fountain roller and said bottom plate.

2. An apparatus according to claim 1, wherein said first member is made of a wear-resistant elastic material.

3. An apparatus according to claim 1, wherein said first member is a plate member arranged in a direction perpendicular to the axial direction of said ink fountain roller and with one end face that press the outer surface of said ink fountain roller and said bottom plate, said third member is a plate member arranged in a direction perpendicular to the axial direction of said ink fountain roller and with one end face that presses said second member by press operation of said press means, and said second member is a thin plate member arranged between the other end face of said first member and one end face of said third member.

4. An apparatus according to claim 3, wherein the thin plate member serving as said second member is made of a thin steel plate with spring properties.

5. An apparatus according to claim 1, wherein said adjustment tool adjusts said first member substantially in a direction toward a position where the outer surface of said ink fountain roller and said bottom plate oppose each other.

6. An apparatus according to claim 1, further comprising an ink fountain key support by a lower surface of the bottom plate and with a distal end projecting toward said ink fountain roller closer than a distal end of said bottom plate, and a projection projecting from a press surface of said first member and in contact with an upper face of the projecting distal end of said fountain key.

7. An apparatus according to claim 1, wherein said third member has an engaging surface formed of a slant surface, and said press means comprises an operation rod biased in a direction to become close to said ink fountain roller and with a distal end engageable with the engaging surface.

8. An apparatus according to claim 1, wherein said adjustment tool comprises a first adjustment bolt (34*b*) moving substantially in a direction toward a position where the outer surface of ink fountain roller and said bottom plate are opposed to each other.

9. An apparatus according to claim 8, wherein said adjustment tool further comprises a second adjustment bolt (34*a*) moving in a direction toward the periphery of said ink fountain roller and a third adjustment bolt (34*c*) moving in a direction toward said bottom plate.

10. An ink fountain apparatus for a rotary printing press, comprising a rotatably supported ink fountain roller, said ink fountain apparatus comprised of a bottom plate arranged at a position close to said ink fountain roller and a pair of ink dams arranged substantially perpendicular to said bottom plate and opposing each other in a widthwise direction of said bottom plate, and an intermediate ink dam arranged between said pair of ink dams, said apparatus comprising a press member which is supported movably, which moves in one direction to press said intermediate ink dam toward an outer surface of said ink fountain roller and toward said bottom plate, and which moves in the other direction to disengage from said intermediate ink dam, thereby allowing removal of said intermediate ink dam;

a holder with a first through hole and adapted to support said intermediate ink dam to be movable in a direction to become close to and away from said ink fountain roller, a spring accepting portion fixed to said press member, a screw with a second through hole in which said press member supported in the first through hole to be movable in the moving direction of said intermediate ink dam extends, said screw being threadably engageable with the other end of the first through hole, and a spring mounted between said spring accepting portion and said screw and adapted to bias a distal end of said press member projecting from one end of the first through hole so as to press said intermediate ink dam, said spring having a biasing force adjusted by pivot motion of said screw.

11. An ink fountain apparatus according to claim 10, wherein said intermediate ink dam includes an incline plane where an angle formed between an extension line thereof and said bottom plate is an acute angle, thereby pressing said intermediate ink dam toward said outer surface of said ink fountain roller and toward said bottom plate by a pressing pressure of said press member.

12. An apparatus according to claim 11, further comprising a holder for supporting said intermediate ink dam to be movable in a direction to become close to and away from said ink fountain roller; and an operating portion formed integrally with said press member and adapted to release a distal end of said press member from the engaging surface against a biasing force.

13. An apparatus according to claim 12, further comprising a support bar extending in axial direction of said ink fountain roller; and a holder having a recess which is fitted into the support bar, thereby allowing the intermediate ink dam to move in the direction of the axis of the ink fountain roller keeping the pressing force against said fountain roller of the intermediate ink dam and bottom plate.

14. An apparatus according to claim 11, further comprising:

an adjustment tool for adjusting a tight contact state of said intermediate ink dam with respect to at least one of the outer surfaces of said ink fountain roller and said bottom plate, and wherein the intermediate in dam comprises:

a first member in contact opposite to an outer surface of the ink fountain roller and the bottom plate;

a second member in contact opposite to the first member; and a third member in contact opposite to the second member, wherein the engaging surface is formed in the third member, and wherein the adjustment tool is provided on the third member to adjust a tight contact state of the first member through the second member.

15. An apparatus according to claim 14, further comprising:

a surface of said first member which contacts said second member and includes a plane (39) which is substantially parallel to said bottom plate and an upright plane (40), said second member being bent and in close contact with parallel plane (39) and upright plane (40), and wherein said adjustment tool comprises:

a first adjustment bolt which adjusts a tight contact state of said first member with respect to the outer surface of said ink fountain roller and said bottom plate by pressing in the vicinity of the bent section of said second member;

a second adjustment bolt which adjusts a tight contact state of said first member with respect to the outer surface of said ink fountain roller by pressing the parallel plane (40) of said first member through said second member; and a third adjustment bolt which adjusts a tight contact state of said first member with respect to said bottom plate by pressing the parallel plane (39) of said first member through said second member.

* * * * *